US005280656A

United States Patent [19]

Gossett

[11] Patent Number: 5,280,656

[45] Date of Patent: Jan. 25, 1994

[54] CONVERTIBLE SOFA/BED

[76] Inventor: Matthew J. Gossett, 4370 N. 66th St., Scottsdale, Ariz. 85251

[21] Appl. No.: 51,558

[22] Filed: Apr. 23, 1993

[51] Int. Cl.[5] ..... A47C 17/04

[52] U.S. Cl. ..... 5/2.1; 5/12.1; 5/136; 297/118

[58] Field of Search ..... 5/2.1, 3, 4, 7, 8, 12.1, 5/136, 162; 297/118, 173

[56] References Cited

U.S. PATENT DOCUMENTS

| | | | |
|---|---|---|---|
| 2,307,920 | 1/1943 | Deschamps | 5/136 |
| 2,770,813 | 11/1956 | Marzillier | 5/136 X |
| 3,088,127 | 5/1963 | Eames | 5/136 X |
| 4,318,195 | 3/1982 | Reppas | 5/2.1 |
| 4,809,371 | 3/1989 | Spitz | 5/2.1 |
| 5,136,737 | 8/1992 | Reppas et al. | 5/2.1 |

*Primary Examiner*—Michael F. Trettel

*Attorney, Agent, or Firm*—William Nitkin

[57] ABSTRACT

A convertible sofa/end table/bed structure having a sofa frame having a first and second pair of sofa legs, the sofa frame being adjacent to one side of an end table having a top member and an upright bed having an upper portion and a lower portion, the lower portion of which is attached to the opposite side of the end table from the sofa. The end table is pivotally attached to pivot support members which are, in turn, attached to the first pair of sofa frame legs adjacent to the end table. The structure is convertible into its bed mode by the top member of the end table being lifted upwards and attached to the rear side of the bed and the bed being rotated downward to a horizontal position above the sofa and end table with the top end of the upper portion of the bed resting on the top of the second pair of sofa legs.

2 Claims, 3 Drawing Sheets

CONVERTIBLE SOFA/BED

BACKGROUND OF THE INVENTION

1. Field of the Invention

The device of this invention resides in the area of convertible furniture and more particularly relates to a sofa/end table/bed member structure that converts into a bed.

2. Description of the Prior Art

Convertible furniture is well known in the prior art. Particularly popular are sofas that can be converted into beds. Some sofas have their seat portions open outward to form a bed. Other convertible sofas have cushions that can be removed, enabling the sofa seat to be directly used as a bed. Another convertible sofa, such as disclosed in U.S. Pat. No. 5,136,737 to Reppas et al, incorporates a mattress positioned to the rear of the sofa which mattress can be manipulated down over the sofa for use as a bed.

SUMMARY OF THE INVENTION

It is an object of this invention to disclose a new and improved convertible sofa/bed structure which has unique advantages in both the storage of the bed member and the usage of the sofa in combination with an end table that is incorporated into the structure. The structure of this invention, when in its sofa mode, consists of a rectangular frame supported at its ends by first and second pairs of legs, a seat cushion placed on the sofa frame, and a back cushion. Unique to the invention is an end table having, in one embodiment, a pivoting planar top member and a first and second pair of of supporting leg members. The end table is positioned adjacent to the first end of the sofa frame. The second pair of legs of the end table is positioned adjacent to, and outboard of, the first pair of legs of the sofa frame. The front legs of the first pair of legs of the sofa frame and the second pair of end table legs that are adjacent to one another are pivotally attached at a front pivot support member near their bases, and the rear legs of the first pair of legs of the sofa frame and the second pair of end table legs that are adjacent to one another are also pivotally attached at a rear pivot support member. At the side of the end table opposite the side adjacent to the sofa frame is a vertically disposed bed member having a front side and a rear side which bed's rear side is attached to members extending between the first pair of supporting legs of the end table. The bed member can have rigid rear support means so that it can maintain a rigid vertical position when in its storage mode and support its mattress portion when in its use mode. The bed member, in its upright, storage mode, takes up very little floor space and can be conveniently positioned near a wall.

When it is desired to convert the sofa/end table structure into its bed mode, the back cushion of the sofa is folded down onto the seat cushion of the sofa. The planar top member of the end table is pivoted upward or otherwise removed. If the planar top member is pivoted upward, it can be attached by a selected one of a variety of attachment means to the rear side of the vertically standing bed member. The bed member is then rotated downward 90 degrees until its rear side rests on top of the second pair of legs of the sofa frame and its front side then acts as the top surface of the bed.

DESCRIPTION OF THE PREFERRED EMBODIMENT(S)

Figure 1:
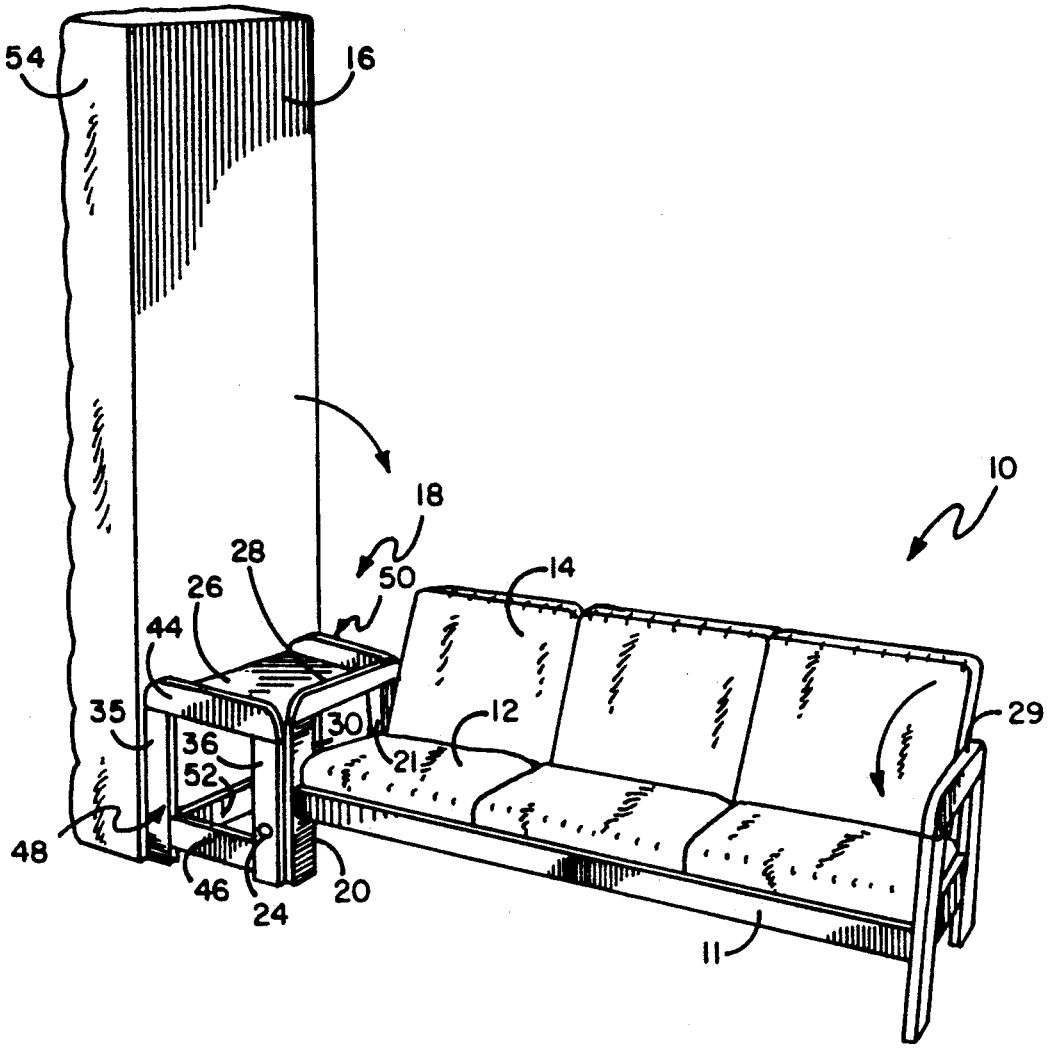
FIG. 1 illustrates a perspective view of the sofa/end table structure of this invention with the sofa in its use mode and the bed member in an upright position.
Figure 2:
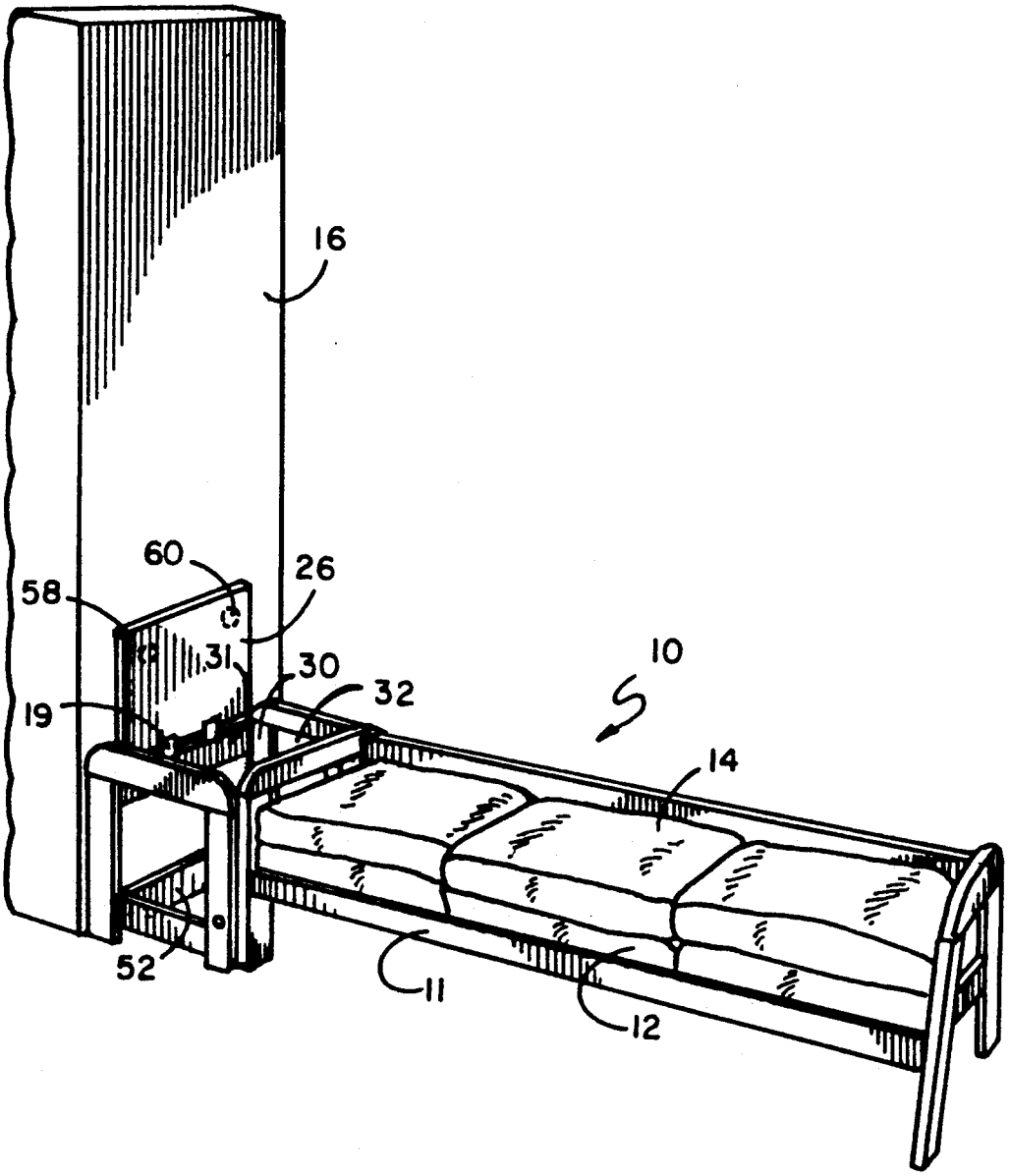
FIG. 2 illustrates a perspective view of the sofa/end table structure of FIG. 1 showing the planar top member of the end table pivoted upward and attached to the rear side of the bed member.
Figure 3:
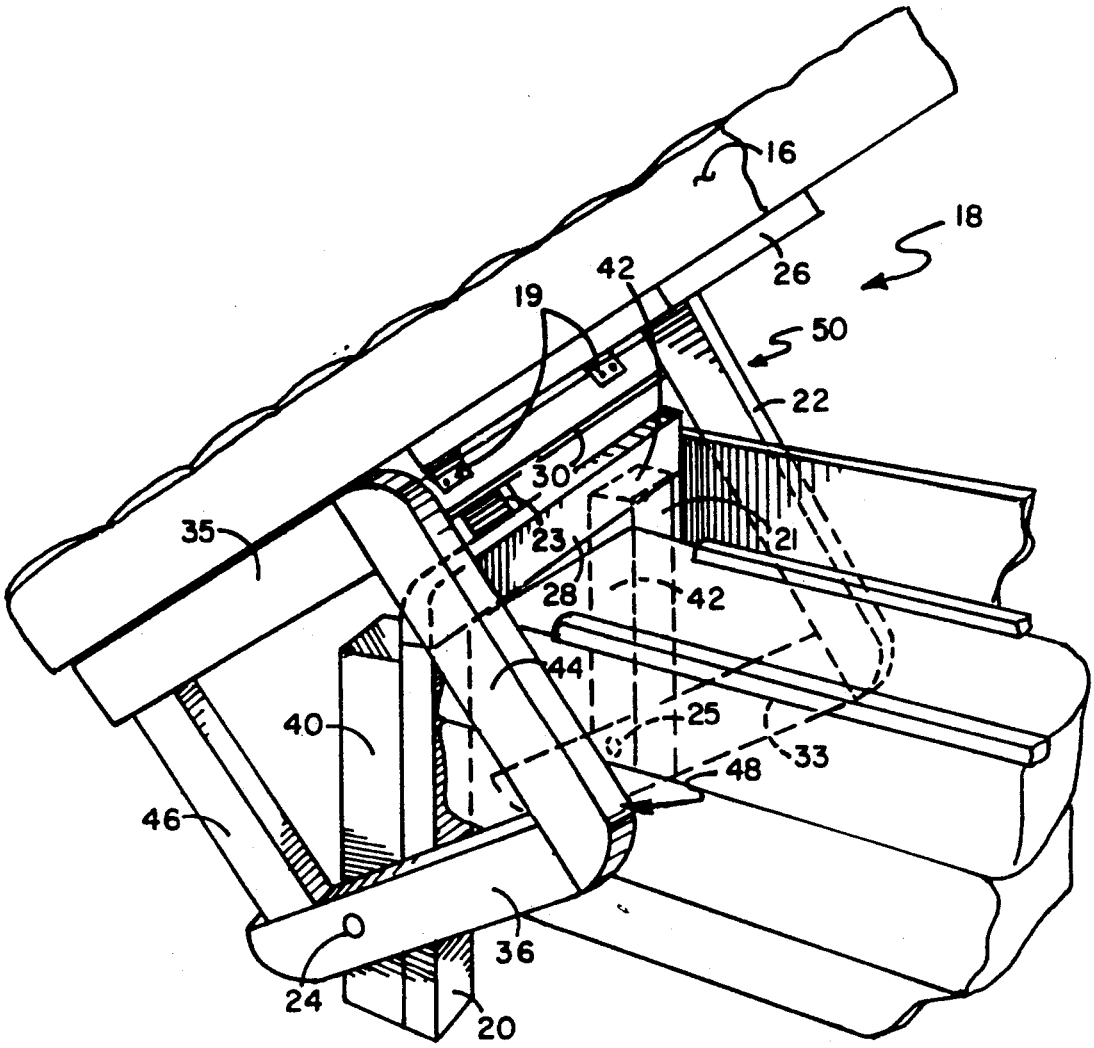
FIG. 3 illustrates an enlarged sectional perspective view of the sofa/end table structure showing the back cushion of the sofa moved forward and resting on the seat cushion and the bed member rotated downward approximately 45 degrees.

FIG. 1 illustrates a perspective view of the sofa/end table structure of this invention showing sofa 10 comprised of a rectangular sofa frame 11 which can be made of metal, wood or other sturdy material having a first and second pair of supporting leg members 28 and 29, respectively, at its first and second ends; seat cushion 12 and back cushion 14. End table 18, having a planar top member 26 having a first and second side 56 and 58 and four leg members being first and second end table front legs 35 and 36 on one side and third and fourth end table rear legs 30 and 33 on the other side seen in dotted lines in FIG. 3 which leg 33 is not generally visible in any of the other Figures, such end table being positioned adjacent to the first end of sofa 10. First and second end table front legs 35 and 36 are each interconnected at their top and bottom by front top member 44 and front bottom member 46. Third and fourth end table rear legs 30 and 33 are mounted opposite first end table front leg 35 and second end table front leg 36 and are similarly interconnected by rear top member 22 and rear bottom member 23 also seen in FIG. 3. Each pair of end table legs and their respective top and bottom interconnection members form an end table front side 48 and an end table rear side 50. Top member 26 acts as the top of end table 18 and is pivotally attached at one end to cross member 31 as seen in FIG. 2. End table 18 can be made of metal, wood or other sturdy material. The legs and interconnecting members of the end table front side 48 and end table rear side 50 are positioned adjacent to, and outboard of, left front leg 20 and left rear leg 21 of the first end of sofa frame 11 which first end is adjacent to end table 18. Second end table front leg 36 is pivotally attached to front pivot support member 40 by front pivot 24, as seen in FIG. 3; and fourth end table rear leg 33 and rear pivot support member 42 are similarly attached by rear pivot 25 to one another. Front and rear pivot support members 40 and 42 are affixed respectively to front leg 20 and rear leg 21 of first pair of sofa legs 28, and front and rear pivot support members 40 and 42 extend upward to form a support for second side 58 of top member 26, as seen in FIG. 2, when top member 26 is pivoted downward into its horizontally disposed end table use mode. The rear of bed member 16 is attached by screws or other equivalent attachment means at its lower portion to top cross member 31 and lower cross member 52 that extend between first end table front leg 35 and third end table rear leg 30.

FIG. 2 is a perspective view of the sofa/end table structure about to be converted to its bed mode. Planar top member 26 of end table 18 has been pivoted upwards on hinge 19 on cross member 31, such hinge 19 being attached to top member first side 56 lifting the opposite side 58 of top member 26 off front and rear pivot support members 40 and 42. Once lifted, top member 26 can be positioned adjacent to the rear side of bed member 16 and attached thereto by magnets 60, hook and loop fasteners such as those sold under the trademark VELCRO, or by equivalent attachment means to hold top member 26 to the rear side of bed member 16. Back cushion 14 of sofa 10 is shown folded down onto seat cushion 12. In another embodiment of the end table not utilizing hinge means, planar top member 26 can be removable from end table 18 and put aside when it is desired to convert the structure into its bed mode. Both embodiments of top member 26 when converting the structure to its bed mode leave an empty space 32 at the top of the end table adjacent to the sofa frame.

FIG. 3 illustrates a sectional perspective view of the sofa/end table midway through its conversion to its bed mode. End table front side 48 and end table rear side 50 of end table 18 are pivoting downward on front pivot 24 and rear pivot 25. Downward rotation of bed member 16 causes the front side 48 and rear side 50 of end table 18 to be moved around first pair sofa legs 28 which legs 28 pass between end table front side 48 and end table rear side 50. Since planar top member 26 of end table 18 has been either removed or lifted on its hinge 19 and attached to the rear side of the bed member as in the embodiment illustrated herein, there is no cross member of the end table to contact first pair sofa legs 28 as bed member 16 is rotated downward and over the top of sofa 10 and which ultimately rests on second pair sofa legs 29 at bed member end 54.

Figure 4:
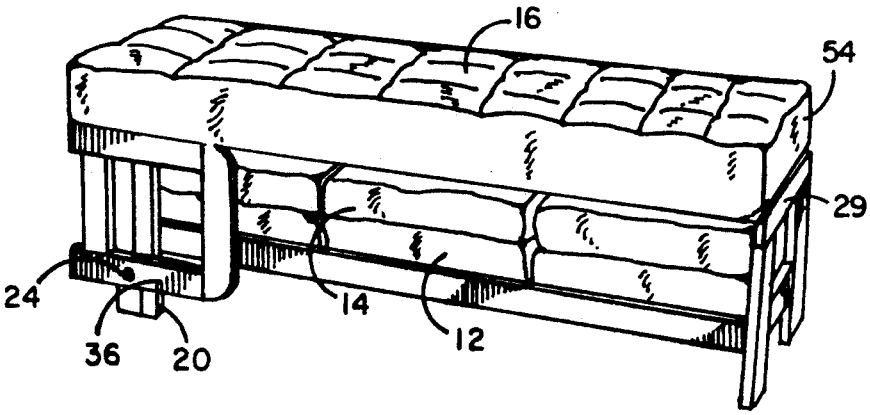
FIG. 4 illustrates a perspective view of the structure of this invention showing the bed member rotated downward approximately 90 degrees onto the second pair of sofa frame legs, forming a bed which incorporates the structure of the end table and sofa thereunder.

FIG. 4 is a perspective view of the completed conversion of the sofa/end table structure to its bed mode. Bed member 16 has been rotated downward approximately 90 degrees, and its bed member end 54 rests on top of second pair sofa legs 29.

The furniture structure in its bed mode can be converted back into its sofa/end table mode by reversing the above steps.

Although the present invention has been described with reference to particular embodiments, it will be apparent to those skilled in the art that variations and modifications can be substituted therefor without departing from the principles and spirit of the invention.

I claim:

1. A furniture structure convertible from a sofa/end table mode to a bed mode, comprising:

a sofa having first and second ends, said sofa having a sofa frame supported by a first and second pair of legs, respectively, at its first and second ends, a seat cushion and a back cushion, said back cushion foldable downward onto said seat cushion, said first and second pairs of legs each consisting of a front leg and a rear leg;

an end table positioned adjacent to said first end of said sofa frame, said end table having:

a first and second pair of end table legs, said first and second pairs of end table legs each consisting of a front leg and a rear leg;

a generally planar top member acting as a table top, said top member having first and second ends, said top member second end positioned adjacent to said second pair of end table legs;

front and rear pivot support members attached, respectively, to the front and rear legs of said first pair of sofa legs;

first and second pivot means pivotally attaching, respectively, the front leg and rear leg of said second pair of end table legs to said front and rear pivot support members, said second pair of end table legs positioned adjacent to, and outboard of, said first pair sofa legs;

a top cross member extending between said first pair of end table legs;

means to remove said planar top member from its position as said table top;

a bed member having a front side and a rear side, said bed member vertically positioned adjacent to, and attached at its rear side to said top cross member extending between said first pair of end table legs; and said furniture structure convertible from its sofa/end table mode to a bed mode by folding downward said back cushion onto said seat cushion, removing said top member from its table top position and rotating said bed member downward approximately 90 degrees causing said second pair of end table legs to rotate on said first and second pivot means until the rear side of said bed member rests horizontally on top of said second pair of sofa legs.

2. The structure of claim 1 wherein said means to remove said top member from its position as a table top comprises:

pivot means pivotally attaching said first side end of said top member to said top cross member, said top member to be pivoted upwards against the rear side of said bed member; and means to releasably attach said top member to the rear side of said bed member.

* * * * *